United States Patent [19]

Rasmussen et al.

[11] 4,042,374

[45] Aug. 16, 1977

[54] MICRON SIZED SPHERICAL DROPLETS OF METALS AND METHOD

[75] Inventors: Don H. Rasmussen; Carl R. Loper, Jr., both of Madison, Wis.

[73] Assignee: Wisconsin Alumni Research Foundation, Madison, Wis.

[21] Appl. No.: 560,478

[22] Filed: Mar. 20, 1975

[51] Int. Cl.[2] ..... B22D 23/08

[52] U.S. Cl. ..... 75/.5 B; 264/5; 264/15

[58] Field of Search ..... 75/.5 B, .5 A; 264/5, 264/15

[56] References Cited

U.S. PATENT DOCUMENTS

| | | | |
|---|---|---|---|
| 2,038,251 | 4/1936 | Vogt | 75/.5 B |
| 2,952,868 | 9/1960 | Rowan | 264/15 |
| 3,019,485 | 2/1962 | Diamond | 264/15 |
| 3,063,099 | 11/1962 | Turner et al. | 264/15 |

*Primary Examiner*—W. Stallard

*Attorney, Agent, or Firm*—McDougall, Hersh & Scott

[57] ABSTRACT

The preparation of micron sized spherical particles of metals comprising emulsification of the metal in the molten state in a carrier fluid, preferably in the form of an inert liquid, and reacting the molten metal while in the emulsified state in the fluid to form an insoluble reaction product on the surface which stabilizes metal droplets in the emulsion.

23 Claims, 4 Drawing Figures

Thermogram for pure tin. Emulsion formed by air oxidation in silicone oil. Melting point, 232°C. Thermogram peak crystallization temperature, 124°C. Peak supercooling, 108 degrees. Supercooling range, 20 degrees.

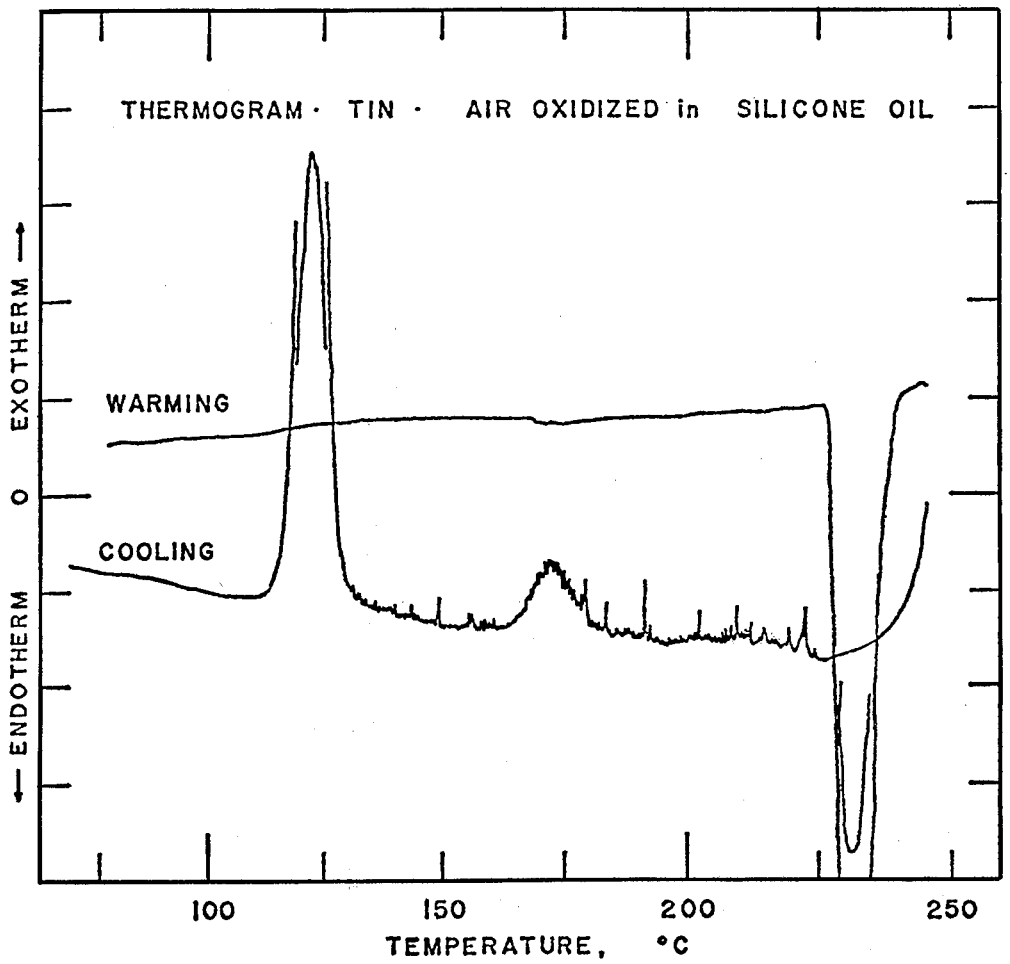
FIG. 3 Thermogram for pure tin. Emulsion formed by air oxidation in silicone oil. Melting point, 232°C. Thermogram peak crystallization temperature, 124°C. Peak supercooling, 108 degrees. Supercooling range, 20 degrees.

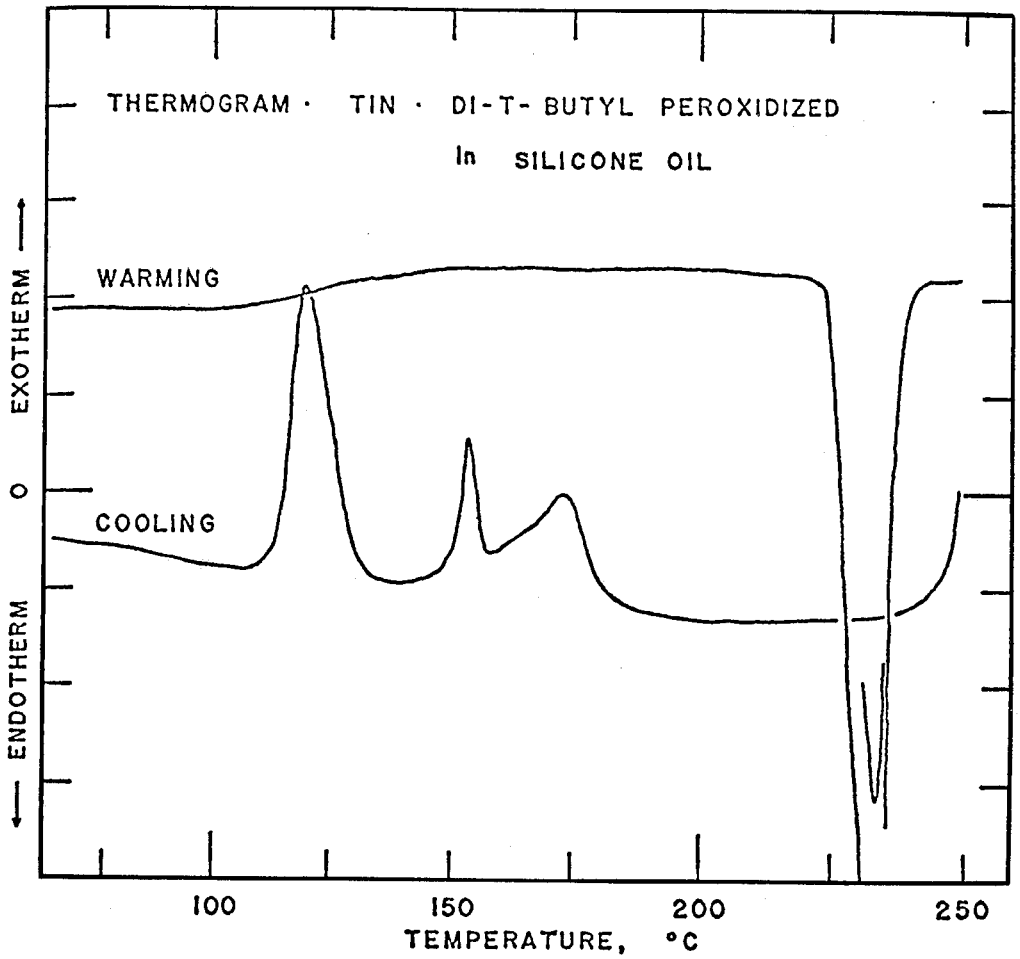
FIG. 4 Thermogram for pure tin. Emulsion formed by di-t-butyl peroxidation in silicone oil in the presence of isophthalic acid. Melting point, 232.5°C. Peak crystallization temperatures for the three exotherms are 175°C., 150°C., and 120°C. Maximum peak supercooling, 112.5 degrees.

MICRON SIZED SPHERICAL DROPLETS OF METALS AND METHOD

This invention relates to stabilized, spherical metal particles of micron size and to methods for producing same, and it relates more particularly to the manufacture of spherical metal droplets of micron size capable of super-cooling from temperatures above the melting point temperature of the metal to temperatures far below their melting point, and which are characterized by long term stability in their metastable super-cooled state. Such micron sized spherical particles find beneficial use as a heat transfer medium, as bearing elements in lubrication and as filler in the manufacture of high density plastics.

It is an object of this invention to produce and to provide a method for producing spherical metal particles of micron size which are stabilized in emulsion to enable heating to a temperature above the melting point temperature of the metal and to enable super-cooling to temperatures far below the melting point temperature; in which the micron sized metal particles can be produced within a narrow size distribution range, and it is a related object to provide a method and means for producing same and for producing compositions containing same for use as a heat exchange medium, high density metal filled plastics or lubricating compositions.

Figure 1:
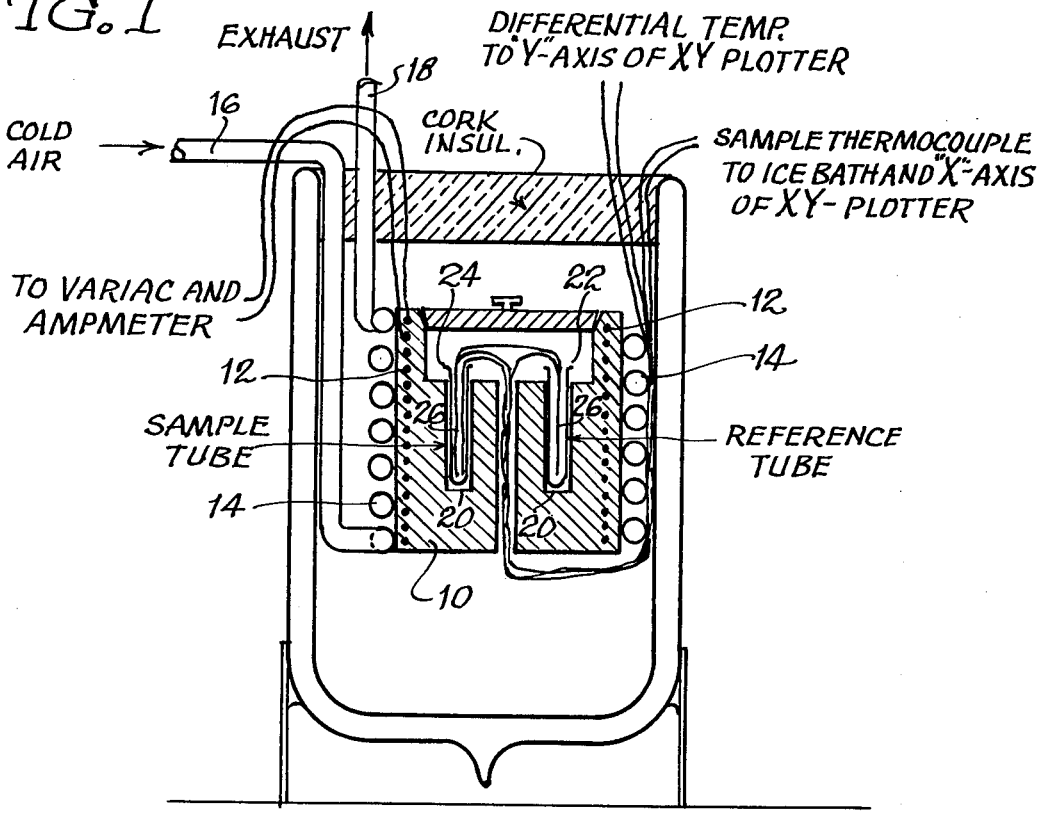
Figure 2:
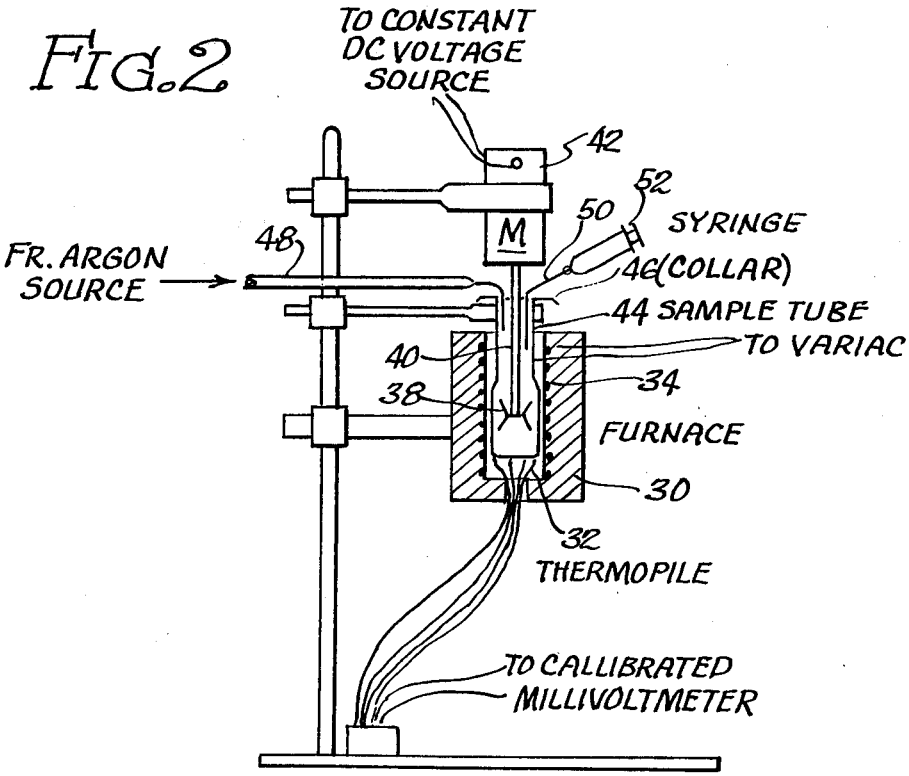

These and other objects and advantages of this invention will hereinafter appear, and for purposes of illustration, but not of limitation, reference will be made to the accompanying drawings in which FIG. 1 is a diagrammatic view of an apparatus for differential thermal analysis used to determine the degree of super-cooling of metal particles prepared in accordance with the practice of this invention, and FIG. 2 is a diagrammatic elevational view of an apparatus which may be used for preparing the metal emulsions of this invention on a laboratory scale.

In accordance with the practice of this invention, the micron sized spherical droplets of metal are formed by (1) emulsification, in an inert atmosphere, of the metal in a stable carrier liquid while at a temperature above the melting point temperature of the metal and preferably at a temperature within the range of 20°–25° above the melting point of the metal or alloy to a maximum temperature corresponding to the boiling point temperature of the carrier liquid or the decomposition temperature of the chemical ingredient reacted to oxidize the surfaces of the molten metal particles and more preferably 20°–50° above the melting point, and (2) reaction, while in the emulsified state, with a chemical which provides the surfaces of the molten metal particles with a reaction product, preferably non-crystalline, which functions as a surfactant to maintain emulsion integrity of the emulsified spherical metal particles in their finely divided separated state.

As the carrier liquid, use can be made of a fluid characterized by (1) low volatility at elevated temperature at which the metal is maintained in the molten state for emulsification; (2) tolerance of an oxidizing atmosphere at temperatures at which the metal is maintained in a molten state for emulsification, such as at a temperature within the range of 250°–350° C for use with such metals as tin, bismuth, lead and alloys thereof, or higher temperatures for use with metals or alloys having a higher melting point temperature; (3) support for the chemical reaction between the molten metal particles and the oxidizing or other agent to provide for emulsion stability and maintenance of the separated relation between the finely divided metal particles in the emulsion. Representative of fluids which can be used as the carrier fluid are such materials as polyhydroxy compounds, polyethers and silicone oils, and preferably polyphenyl ethers having 5 to 6 benzene rings, as represented by a polyphenyl ether marketed by Monsanto Chemical Company under the trade designation OS-124, having a boiling point above about 500° C and which is stable to air oxidation at a temperature over 400° C.

As the surface reactant use is made of an oxidizing agent alone or in combination with an acid which catalyzes the oxidation reaction, which operates to raise the molten metal droplet to a charged state, or provides a suitable anion as a coating on the surface of the droplet to facilitate maintenance of the particles in the emulsified state in the carrier fluid.

For this purpose, use can be made of an oxidizing agent that is reactive with the molten metal to yield reaction product on the surface of the molten metal particles which does not vaporize off and is insoluble in the carrier fluids. Representative of the reactions which may be employed is the use (1) of an agent, such as oxygen, sulphur, or sulphuric acid which reacts directly with the molten metal at the surface to form the corresponding metal oxide, sulphide or sulphate; (2) salts of metals below the molten metal in the electromotive series for reaction by substitution or displacement, or electrochemical oxidation wherein the anion is preferably an isophthalate or terephthalate, for example with tin, bismuth or lead, it is preferred to make use of copper or silver as the cation and isophthalate or terephthalate as the anion; and (3) a peroxidizing agent, symmetrical or unsymmetrical, such as benzoyl peroxide, di-t-butyl peroxide or cumene hydro-peroxide. Beneficial use has been made of such oxidation catalysts having a half-life of $\frac{1}{4}$ to 2 seconds and preferably about $\frac{1}{2}$ to 1 second.

When the oxidation reaction is catalyzed by an acid, the latter should be selected on the basis of (1) non-reactivity with the molten metal, (2) solubility in the carrier liquid, (3) stability in solution at reaction temperature, (4) inability to react directly with the oxidizing agent to form an inactive product at the surface, and (5) catalyzes the oxidation of the metal at the surface to produce a product that is uniform from the standpoint of super-cooling and the like. Dicarboxylic acid, isophthalic acid and terephthalic acid are representative of the acidic compounds that can be used alone or as the anion in the salts of a metal lower in the electromotive series for substitution or displacement reaction.

The micron sized spherical droplets of metals are formed in accordance with the practice of this invention by controlled emulsification. The described process of controlled emulsification of liquefied metals can be used to generate spherical droplets in the size range of 1 to 200 microns in diameter. To the present, the controlled emulsification process of this invention is capable of generating droplets of metals that melt between ambient temperature and 400° C. By proper selection of carrier fluid and emulsification equipment, the process of this invention can be extended to use with metals and alloys besides tin, lead and bismuth, melting at such higher temperatures.

The amount of super-cool is an important characteristic indicative of the utility of the emulsified spherical metal particles of this invention as a heat transfer method. The super-coolings of the emulsions prepared in accordance with the practice of this invention were determined by differential thermal analysis (DTA). Differential thermal analysis determines the temperature of the thermal events, such as crystallization or melting. It is not quantitative, as required to determine heats of transition or specific heat during warming and cooling.

The metal emulsions prepared in accordance with the practice of this invention are characterized by long term stability in the metastable super-cooled state. The metal droplets can be heated to temperatures above their melting point and then super-cooled to 100°-130° C below their melting point before the droplets nucleate and crystallize.

This unique physical effect of the formation and stabilization of metal droplets, which super-cool over appropriate wide temperature ranges, permits the use of the metal droplets and emulsions as heat transfer media capable of carrying heat from high temperature sources above the melting point of the droplets to a low temperature receiver below the temperature of nucleation and crystallization, with an overall efficiency greater than that of a normal Carnot cycle, based upon single phase specific heats.

Differential thermal analysis is based upon the principle that if a sample and an inert reference material are heated simultaneously, in symmetrically located positions, in a thermal conducting block, then the temperature difference between the sample and the reference material will remain about zero, except when some thermal event occurs, such as crystallization (which liberates heat), or melting (which absorbs heat). When such event occurs, the temperature of the sample either exceeds or becomes less than that of the reference material and the temperature difference exhibits a positive or negative peak.

The differential thermal analysis apparatus used to determine the amount of super-cool of the metal emulsions prepared in accordance with the practice of this invention, is illustrated in FIG. 1 of the drawing. It consists of an aluminum block 10 concentrically surrounded internally with resistance heating elements 12 and outwardly with coils 14 through which air is caused to circulate from an inlet 16 to an outlet 18. The aluminum block 10 is drilled to provide wells 20 having a diameter of about 3/16 inch and concentrically spaced about 5/16 inch from the center of the block.

The wells 20 are adapted to receive pyrex tubes 22 and 24, one of which (22) is a sample tube while the other (24) is a reference tube, each tube being provided for the insertion of thermocouples 26 for the measurement of temperature of the material in the tubes. The output from the thermocouple of the sample tube was referenced to an ice bath and displaced on the X axis of an XY recorder while the output from the thermocouple between sample and reference was amplified and displayed on the Y axis of an XY recorder. The reference material comprised metal-free carrier fluid used in the emulsion.

Having described the basic concepts of this invention and the characteristics of the materials entering into the reaction, a more detailed description of the invention will hereinafter be made by way of the following examples, which are given for purposes of illustration and not by way of limitation. While the examples will describe the preparation, using the apparatus shown in FIG. 2, it will be understood that the same concepts can be scaled up from the laboratory apparatus to large scale commercial procedures and apparatus for industrial use.

The apparatus illustrated in FIG. 2 includes a furnace 30 having a heating space 32 surrounded with electrical resistance wires 34 or other heating coils controlled by a variac. A high speed stirrer 38 is mounted to extend into the space 32 of the heating furnace 10 for rotational movement at higher speeds through a shaft 40 connected to a driving motor 42. A pyrex tube 44, which is adapted to extend into the furnace space 32, is provided with a cover in the form of a collar 46 having openings for the introduction of an inert gas from conduit 48 which is connected to a source of supply of an inert gas such as argon; an inlet connected by conduit 50 to an injection device 52 for the introduction of one or more reactants; and an opening for the passage of the shaft 40 connecting the driving motor to the stirrer, when the latter is located within the tube.

EXAMPLE 1

2 grams of pure tin, along with 0.1 gram of terephthalic acid, and 5 cc of silicone oil were introduced into the pyrex tube. Argon was continuously circulated into the tube to purge the tube before heating and to maintain inert atmospheric conditions during reaction and while the tin was in the molten state. The furnace was adjusted for heating the ingredients in the tube to a temperature of about 25° C above the melting point temperature or 232° C for tin. When the desired temperature conditions were reached, and the tin was reduced to the molten state (about 10 minutes), the motor was activated to rotate the stirrer at high speed, such as at 28,000 rpm.

Under these conditions, the molten metal was sheared into a fine droplet dispersion and then 2 cc of a 10% by weight solution of di-t-butyl peroxide in silicone oil was introduced through line 50 with continued emulsification for a short period of time of about ½ to 1 minute. Upon removal from the furnace, a fine powder of tin settled to the bottom of the tube.

In a series of experiments, Example 1 was repeated except that instead of silicone oil, corresponding amounts of other fluids including polyphenyl ether having 5 to 6 benzene rings (OS-124) and silicone fluid (Dow-Corning 704) was used.

EXAMPLES 2 to 9

These examples are addressed to the determination of the effect of the use of various modes of oxidation in which the procedure of Example 1 was repeated in each example with the exception that polyphenyl ether containing 5 to 6 benzene rings (OS-124 of Monsanto Chemical Company) was used as the carrier fluid instead of silicone oil. The oxidants used in the examples included sulphur (Example 2), sulphuric acid (Example 3), air (Example 4), cumene hydroperoxide (Example 5), copper isophthalate (Example 6), silver isophthalate (Example 7), di-t-butyl peroxide in the presence of isophthalic acid (Example 8) and benzoyl peroxide in the presence of isophthalic acid (Example 9).

All reactions were carried out in the presence of Argon as an inert gas, except for Example 4 in which air was used as the oxidant.

While the droplet size varied somewhat in the different examples, depending upon the oxidizing technique, the size distribution of the droplets was quite narrow, averaging about 10 micrometers in diameter. For example, in Example 8, the droplets had a mean diameter of about 10.16 micrometers, with a deviation of only about 2.24 micrometers. This amounted to subdivision of 1 gram of tin into 109 droplets, which is sufficient to separate any impurity or catalyst particles, and any residual oxide present in the original metal into a very small fraction of the total emulsified tin.

The thermograms were obtained by differential thermal analysis. The heating curves indicate no thermal transition in the products prior to melting of the tin and the cooling curves indicate no important thermal phenomenon prior to a moderately sharp exothermic crystallization of the tin at supercoolings characteristics of each oxidation system.

The supercoolings were not affected by recycling the samples of each example through several heatings and coolings, or by heating the emulsion to about 50° C above the melting point of tin. The supercoolings observed for the emulsions of Examples 2 to 9 are presented in Table I.

TABLE I

EFFECT OF DROPLET COATING ON SUPERCOOLING OF PURE TIN

| Example | Emulsion formed in polyphenol ether by reaction with | Supercooling Exotherm maximum, degrees C. | Range, degrees C. |
|---|---|---|---|
| 2 | Sulfur | 50 | 15 |
| 3 | Sulfuric acid | 85 | 10 |
| 4 | Air | 105 | 16 |
| 5 | Cumene hydroperoxide | 108 | 20 |
| 6 | Copper isophthalate | 121 | 27 |
| 7 | Silver isphthalate | 117 | 26 |
| 8 | Di-t-butyl peroxide in the presence of isophthalic acid | 117 | 17 |
| 9 | Benzoyl peroxide in the presence of isophthalic acid | 116 | 18 |

Differences in supercoolings were observed for the different surface coatings derived from the various modes of oxidation but a fairly narrow range of supercoolings was observed for each emulsion, indicating uniform droplet behavior with the nucleation terminating supercooling being dependent on the properties of the liquid droplets or the nature of the surface coating. Maximum supercoolings were obtained with both the peroxide-oxidized material and in the examples which made use of substitutional oxidation by copper or silver isophthalate.

When terephthalic acid is substituted for isophthalic acid in Examples 8 and 9, little, if any, change was experienced in supercooling. This indicates that the carrier fluid has little, if any, effect on the supercooling of tin droplets prepared in accordance with the practice of this invention.

EXAMPLES 10 to 13

The following examples are addressed to the practice of this invention with tin alloyed with lead and with bismuth. Lead was used as an alloying element with tin since, at the temperature of nucleation observed for pure tin, there is little, if any, solid solubility for lead in tin. Bismuth was used as an alloying element with tin because bismuth is soluble in the solid state to about 10% by weight at these same temperatures. These examples were performed to inquire about the effect of such alloying elements on supercoolings, of the formed emulsions, as a function of solute content.

The procedure of Example 1 was repeated but with an alloy of 80 parts by weight tin to 20 parts by weight of lead instead of pure tin as the metal component. In Example 10, copper isophthalate was used as the oxidant. In Example 11, silver isophthalate was used as the oxidant. In Example 12, benzoyl peroxide was used as the oxidant in the presence of isophthalic acid. In Example 13, di-t-butyl peroxide was used as the oxidant in the presence of isophthalic acid.

The emulsions that were formed were of similar size, averaging 8.73 micrometers in diameter with a standard deviation of 2.20 micrometers. The supercoolings were uniform, depending somewhat on the surface coatings of the metal components.

EXAMPLES 14 to 34

These examples were performed with tin-lead alloy ranging from 100% tin to 100% lead for emulsion in polyphenyl ether containing 5 to 6 benzene rings (OS-124) and various oxidation techniques including peroxidation with di-t-butyl peroxide in the presence of isophthalic acid, substitutional oxidation with copper and silver isophthalate, benzoyl peroxidation in the presence of isophthalic acid, and air oxidation as set forth in the following tabulation:

TABLE II

MAXIMUM SUPERCOOLINGS FOR TIN - LEAD ALLOYS EMULSIFIED BY VARIOUS OXIDATION TREATMENTS

| Example | WT % LEAD | Oxidation Treatment | Supercooling |
|---|---|---|---|
| 14 | 0 | 1 | 117 |
| 15 | 0 | 2 | 121 |
| 16 | 0 | 3 | 116 |
| 17 | 5 | 1 | 118 |
| 18 | 10 | 1 | 117 |
| 19 | 10 | 2 | 108 |
| 20 | 10 | 3 | 117 |
| 21 | 15 | 1 | 118 |
| 22 | 20 | 1 | 118 |
| 23 | 20 | 2 | 85 |
| 24 | 20 | 3 | 115 |
| 25 | 30 | 1 | 78 |
| 26 | 30 | 2 | 83 |
| 27 | 30 | 3 | 100 |
| 28 | 40 | 1 | 77 |
| 29 | 40 | 2 | 70 |
| 30 | 40 | 3 | 100 |
| 31 | 50 | 3 | 125 |
| 32 | 60 | 3 | 130 |
| 33 | 70 | 3 | 143 |
| 34 | 100 | 4 | 78 |

*Oxidation Treatments for emulsions prepared in polyphenyl ether.
1 Di-t-butyl peroxidation in the presence of isophthalic acid.
2 Copper or silver isophthalate substitutional ionization.
3 Benzoyl peroxidation in the presence of isophthalic acid.
4 Air oxidation.

Emulsions formed by substitutional oxidation with copper isophthalate and silver isophthalate indicated that there was no effect of lead concentration on the temperature of crystallization. The supercoolings decrease with the addition of lead.

Emulsions formed by benzoyl peroxidation with benzoyl peroxide in the presence of isophthalic acid indicated that in alloys in which the tin content was high, the initial addition of lead depressed the temperature at which crystallization was observed. The highest crystallization temperature, i.e., the smallest super-cooling, maintained a super-cooling of about 50° C between 40–70% lead.

Emulsions formed by di-t-butyl peroxidation indicated that uniform maximum super-coolings were achieved by the substitution of di-t-butyl peroxide for benzoyl peroxide. The thermograms for 5, 10, 15 and 20% by weight lead demonstrated that uniform supercoolings were obtained throughout the entire range. These super-coolings were the maximum observed for pure tin, or lead-tin alloys containing up to 20% by weight lead. In this range, the super-coolings were constant at about 117° C, independent of lead concentration. The maximum super-coolings for higher lead content alloys, oxidized with benzoyl peroxide, were nearly 140° C.

EXAMPLES 35 to 54

These examples are addressed to the emulsification of tin-bismuth alloys ranging from 90% tin and 10% bismuth to 50% tin and 50% bismuth, as set forth in the following tabulation.

As in Example 1, 2 grams of tin-bismuth alloy was reduced to the molten state in the emulsifier tube, under an atmosphere of Argon, in Polyphenyl ether (OS-124), and then stirred until a uniform droplet of metal was obtained. The oxidants used to permit emulsification in accordance with the practice of this invention were air in the presence of isophthalic acid, silver isophthalate and di-t-butyl peroxide in the presence of isophthalic acid.

TABLE III

MAXIMUM SUPERCOOLINGS FOR TIN-BISMUTH ALLOYS EMULSIFIED BY VARIOUS OXIDATION TREATMENTS

| Example | Wt % BISMUTH | Oxidation Treatment* | Supercooling from liquidus | Supercooling from solidus |
|---|---|---|---|---|
| 35 | 0 | 1 | 117 | 117 |
| 36 | 0 | 2 | 117 | |
| 37 | 0 | 3 | 105 | |
| 38 | 2.2 | 1 | 128 | 117 |
| 39 | 5 | 1 | 134 | 117 |
| 40 | 10 | 1 | 136 | 102 |
| 41 | 10 | 2 | 125 | |
| 42 | 10 | 3 | 79 | |
| 43 | 15 | 1 | 129 | |
| 44 | 20 | 1 | 123 | |
| 45 | 20 | 2 | 115 | |
| 46 | 20 | 3 | 85 | |
| 47 | 30 | 2 | 112 | |
| 48 | 30 | 3 | 89 | |
| 49 | 40 | 2 | 93 | |
| 50 | 40 | 3 | 93 | |
| 51 | 50 | 2 | 91 | |
| 52 | 50 | 3 | 90 | |
| 53 | 100 | 1 | 160 | |
| 54 | 100 | 3 | 160 | |

*Oxidation treatments for emulsions prepared in polyphenyl ether.
1 Di-t-butyl peroxidation in the presence of isophthalic acid.
2 Silver isophthalate substitutional ionization.
3 Air oxidation.

The tin-bismuth alloys formed very uniform emulsions with somewhat broader droplet size distribution than with tin or with tin-lead alloys. The emulsion size distribution in Example 42 for a 90% tin – 10% bismuth alloy, had a diameter of 8.48 micrometers with a standard deviation of 2.08 micrometers.

The supercoolings calculated from the solidus below 7% by weight bismuth was constant at 117° C. This is the same as the supercoolings observed for tin-lead alloys below 20% by weight lead and emulsified with di-t-butyl peroxidation.

Additional utility for the micron sized spherical metal droplets produced in accordance with the practice of this invention include use in solar energy heat transfer and storage or as a coolant and heat transfer medium for transformers and the like.

Suspension as micron sized spherical metal droplets in various oils or fluids represent valuable compositions having such possible uses as in lubrication. When such micron sized metal droplets are embodied as a component in cross-linkable carrier fluids, unique metal filled plastics can be produced.

While the process have been described with reference to the use of metals having a melting point below the upper temperature limit of stability for fluids in which the metal is emulsified, it will be understood that with the use of materials having higher temperature stability, such as reducing glasses, fused salts, or fluidized beds of reducing materials, other metals and alloys having higher melting points can be adapted to emulsification into micron sized droplets in accordance with the practice of this invention.

Such greater flexibility in the selection of metals and alloys of metals occurs when, in accordance with the practice of this invention, atomization of the molten metal or alloy to form the fine micron sized droplets is carried out in a fluid in the gaseous state, instead of a liquid state, while the fluid is at a temperature above the melting point temperature of the atomized molten metal particles, and in which reactants are present, preferably also in the vapor state, whereby reaction takes place immediately on the surfaces of the atomized molten metal particles, as by oxide formation, sulfate formation or peroxidation, as previously described, to prevent coagulation of the molten metal particles. Atomization devices suitable for use in the atomization of molten metal particles into a vapor atmosphere are well known.

The formation of micron sized droplets, in accordance with the practice of this invention, can be utilized to effect removal of contaminants or impurities, even when present in only very minor amounts, thereby to provide a method of purification and preferably the preparation of super-pure metals and alloys of metals. The technique described has application for purification of materials other than metals and alloys of metals.

It is believed that this represents a wholly unexpected and unique concept in purification techniques of metals as well as non-metals. Applicants have theorized that removal of impurities or contaminants by formation of micron sized droplets depends somewhat on the tendency of the contaminants or impurities preferentially to cluster. Thus when the micron sized droplets are formed, a non-statistical separation of impurities or contaminants will take place whereby some of the formed micron sized droplets will contain a higher concentration of the impurities or contaminants than others. Droplets containing solid impurities will necessarily crystallize at temperatures higher than impurity-free particles. Droplets containing impurity crystallize by heterogeneous nucleation. Droplets free of impurity crystallize by homogeneous nucleation.

A sample containing some droplets free of impurity and other droplets containing impurity can be separated by first solidifying only the impurity containing droplets by proper temperature cycling and by then applying appropriate physical methods. Separation can be based on any reasonable differences in physical properties between liquid and solid metal, i.e., (1) specific gravity, (2) magnetic susceptibility and (3) electrical properties.

For example, as described, the size of the droplets, produced in accordance with the practice of this invention, may average about 10 micrometers in diameter, with a deviation of 2.24 micrometers. This means that a 1 gram sample of tin will divide into $10^9$ droplets. With droplet sizes of this magnitude, the concentration of impurities would not be uniform between droplets, unless the impurity were soluble in the tin at molten temperature, so that some droplets would contain nucleating impurities or contaminants and others would not.

Thus separation of the solidified droplets, as by one of the techniques described, will result in the remainder of the body of droplets having a lower concentration of impurities or contaminants by comparison with the original material. This method thereby provides a simple and efficient means for the preparation of a superpure material, be it a metal, metal alloy, or non-metallic material.

It will be apparent that the described technique depends upon a non-statistical separation of impurities between the formed micron sized droplets. Thus the technique is not applicable to the separation of impurities or contaminants where such non-statistical separation cannot occur, such as when the impurities or contaminants are in solution in the molten material.

That such clustering of impurities takes place during the formation of the micron sized droplets, in accordance with the practice of this invention, can be illustrated by reference to the thermogram for tin (m.p. 232° C), subjected to oxidation in air during emulsification to form micron sized droplets in silicon oil.

It will be seen from the cooling curve in the thermogram, reproduced as FIG. 3, that the major peak occurs at about 124° C, while a minor peak occurs at about 140° C, indicating the presence of micron sized droplets having a composition differing from that of the main body of material crystallizing at 124° C. Such differences in composition are exhibited, in the micron sized particles, by differences in physical properties, especially when the impure particles are in the solid state and the more pure are still in the liquid state. This enables separation by known techniques. Such differences in peaks are clearly indicative of a non-statistical separation of components within the molten tin, whereby separation with resultant purification can be achieved.

This is also illustrated by the thermogram for tin wherein the micron sized particles are formed by di-t-butyl peroxidation in silicon oil, in the presence of isophthalic acid, in accordance with Example 1 (see FIG. 4). Non-statistical separation of two or more impurities or contaminants is shown by the separate peaks at 175° C and at 150° C, with the contaminant free particles crystallizing at 120° C. Such peaks result from clustering of foreign materials which nucleate the tin to provide the basis for separation which enables purification to be effected by reason of the differences in physical properties. In this example, an emulsion cooled from 250° to 140° C will exhibit crystallization of all droplets containing either type of impurity, while the impurity free droplets will remain as liquids. Physical separation methods could then be employed at any temperature above 140° C, but below 230° C. It will usually be advantageous to rewarm the system to a temperature nearer the melting point to provide a greater temperature buffer zone to avoid crystallization of the pure droplets which begins at 130° C.

It will be understood that changes may be made in the details of the materials, their formulation and operation, without departing from the spirit of the invention, especially as defined in the following claims.

We claim:

1. The method of preparing micron sized spherical droplets of metals comprising the steps of emulsifying the metal in a molten state in an inert carrier fluid and reacting the molten metal while in the emulsified state in the fluid to form a reaction product on the surface while stabilizes the metal droplets in the emulsion.

2. The method as claimed in claim 1 in which emulsification of the metal in the molten stage in the carrier fluid is effected by heating the metal and carrier fluid to a temperature above the melting point temperature for the metal but below the temperature for volatilization or instability of the carrier fluid.

3. The method as claimed in claim 2 in which the metal and fluid are maintained in an inert atmosphere during heating and emulsification.

4. The method as claimed in claim 1 in which the carrier fluid has a boiling point above the melting point temperature of the metal and which is stable at said temperature and not reactive with the metal or the reaction product formed on the surface thereof.

5. The method as claimed in claim 1 in which the metal and carrier fluid are heated to a temperature 20°–50° C above the melting point temperature of the metal.

6. The method as claimd in claim 1 in which the metal and carrier fluid are heated to a temperature 20°–25° C above the melting point temperature of the metal.

7. The method as claimed in claim 1 in which the molten metal in the emulsified state in the carrier fluid is reacted with an oxidizing agent to form the reaction product on the surfaces of the metal droplets.

8. The method as claimed in claim 7 in which the oxidizing agent is oxygen, sulphur or sulphuric acid to form the corresponding metal oxide, sulfide or sulfate as a reaction product on the surfaces of the metal droplets.

9. The method as claimed in claim 7 in which the oxidizing agent is a salt of a metal which is below the metal to be emulsified in the electromotive series whereby the reaction is by substitution or displacement to form the reaction product on the surfaces of the metal droplets.

10. The method as claimed in claim 9 in which the metal salt is a salt formed of a metal as the cation and an organic acidic group as the anion.

11. The method as claimed in claim 10 in which the organic acidic group is selected from the group consisting of isophthalic acid and terephthalic acid.

12. The method as claimed in claim 7 in which the chemical reaction is one providing a peroxidation reaction.

13. The method as claimed in claim 12 in which the peroxidizing agent has a half-life of ½ to 2 seconds.

14. The method as claimed in claim 12 in which the peroxidizing agent is employed in the presence of an acid catalyst.

15. The method as claimed in claim 14 in which the acid catalyst is isophthalic acid or terephthalic acid.

16. The method as claimed in claim 1 in which the micron sized droplets are of spherical shape having a diameter within the range of 1 to 200 micrometers.

17. The method as claimed in claim 1 in which emulsion is characterized by a high degree of supercool to enable its use as a heat exchange medium.

18. The method as claimed in claim 1 in which the emulsion of metal droplets can be heated to a temperature as much as 50° C above the melting point for the metal and supercooled to a temperature more than 100° C below the melting point of the metal.

19. A metal emulsion produced by the method of claim 1 characterized by metal droplets suspended in an inert liquid carrier in which the metal droplets are of spherical shape having a diameter within the range of 1 to 200 micrometers and can be supercooled to a temperature below the melting point temperature of the metal.

20. A metal emulsion as claimed in claim 19 in which the spherical metal droplets are of micron size having a stabilized reaction product on their surfaces which stabilizes the droplets in the emulsion.

21. A metal emulsion as claimed in claim 20 in which the metal is selected from the group consisting of tin, lead, bismuth and alloys thereof.

22. A method for processing a material formed of at least two components, at least one of which tends to cluster when the material is reduced to micron sized particles from a molten state, comprising heating the material to a molten state, reducing the molten material to micron sized particles in the presence of a reactant which forms a reaction product on the surfaces of the formed molten micron sized particles to inhibit their agglomeration whereby as a result of non-statistical separation, some of the micron sized particles contain a concentration of one component which is higher than the concentration of that component in the original material, while other micron sized particles contain a concentration of the one component which is less than the concentration in the original material, and then separating the particles in response to physical or chemical properties based upon such differences in concentration of the impurity component.

23. The method as claimed in claim 22 which includes the step of cooling the micron sized particles from a molten state before separation.

* * * * *